US008104400B2

(12) United States Patent
Koreda et al.

(10) Patent No.: US 8,104,400 B2
(45) Date of Patent: Jan. 31, 2012

(54) HUSKING-ROLL DRIVING DEVICE IN HULL REMOVER

(75) Inventors: Minoru Koreda, Tokyo (JP); Seiji Yorioka, Tokyo (JP); Chozaburo Ikuta, Tokyo (JP)

(73) Assignee: Satake Corporation, Tokyo (JP)

( * ) Notice: Subject to any disclaimer, the term of this patent is extended or adjusted under 35 U.S.C. 154(b) by 825 days.

(21) Appl. No.: 12/230,388

(22) Filed: Aug. 28, 2008

(65) Prior Publication Data

US 2009/0056563 A1 Mar. 5, 2009

(30) Foreign Application Priority Data

Aug. 30, 2007 (JP) ..... 2007-224704
Jun. 30, 2008 (JP) ..... 2008-170580

(51) Int. Cl.
*B02B 3/00* (2006.01)

(52) U.S. Cl. ..... 99/617; 99/600; 99/488; 426/482; 426/518; 241/7

(58) Field of Classification Search ..... 99/518–531, 99/619, 574, 486, 488, 600–606, 489, 609–618, 99/620–625; 404/133.05; 92/136; 426/518; 241/7

See application file for complete search history.

(56) References Cited

U.S. PATENT DOCUMENTS

| | | | | | |
|---|---|---|---|---|---|
| 2,669,268 | A * | 2/1954 | Meyer | 99/569 |
| 4,066,012 | A * | 1/1978 | Satake et al. | 99/618 |
| 4,194,445 | A * | 3/1980 | Gemsjager | 99/618 |
| 4,295,420 | A * | 10/1981 | Satake et al. | 99/486 |
| 5,678,477 | A * | 10/1997 | Satake et al. | 99/519 |
| 5,873,301 | A * | 2/1999 | Satake et al. | 99/488 |
| 6,347,579 | B1 * | 2/2002 | Houri et al. | 99/488 |
| 7,296,511 | B2 | 11/2007 | Koreda et al. | |
| 2010/0018387 | A1 * | 1/2010 | Miyazawa | 92/136 |

FOREIGN PATENT DOCUMENTS

| | | |
|---|---|---|
| JP | 62-29064 | 7/1987 |
| JP | 03-106452 | 5/1991 |
| JP | 03-137945 | 6/1991 |
| JP | 2001-038230 | 2/2001 |
| JP | 2006-312151 | 11/2006 |
| JP | 2007330859 A * | 12/2007 |

* cited by examiner

*Primary Examiner* — Gene Kim
*Assistant Examiner* — Matthew B Stanczak
(74) *Attorney, Agent, or Firm* — Staas & Halsey LLP

(57) ABSTRACT

There are provided a first belt-clutch mechanism switching power transmission to a first large-diameter pulley, and, at the same time, a second belt clutch mechanism switching power transmission to a second large-diameter pulley, and a first and a second belt clutch mechanism are provided with a first and a second arm members, tension clutch pulleys installed at point portions of these arm members, and actuators which rotate a first and a second arm members in such a way that a position at which a first no-end belt is wound on the first large-diameter pulley is switched to a position at which winding is avoided, and, at the same time, a position at which a second no-end belt is wound on a second large-diameter pulley is switched to a position at which winding is avoided.

5 Claims, 6 Drawing Sheets

WHEN THE ROLL IS A NEW ARTICLE
THE FIRST DRIVE MOTOR 7···ON
THE SECOND DRIVE MOTOR 8···OFF

WHEN THE ROLL WEARS OUT
THE FIRST DRIVE MOTOR 7···OFF
THE SECOND DRIVE MOTOR 8···ON

HUSKING-ROLL DRIVING DEVICE IN HULL REMOVER

BACKGROUND OF THE INVENTION

1. Field of the Invention

The present invention relates to a hull remover by which hulls are removed from unhulled rice, and un-milled rice is retrieved, and, especially, to a couple of husking-roll driving devices with an operation (hull removing) in which hulls are peeled off from unhulled rice.

2. Description of the Related Art

The hull remover has a type by which a couple of rubber rolls are respectively rotated in the opposite directions to each other, and with different peripheral velocity from each other, un-hulled rice is supplied to a gap between the above-described couple of the rubber rolls, and shearing fracture of hulls are performed by a difference of peripheral velocities between the rollers for hull removing.

The couple of rubber rolls are a main roll, and a sub roll, but the wear of the main roll and that of the sub roll are different from each other (a deviation is caused) by a difference between the peripheral velocity of the main roll and that of the sub one. Accordingly, the wear levels are usually made the same by manual replacement operation of the rubber rolls of the main and the sub rolls. The lives of the main and sub rolls are extended by the above operations, and the above hull remover is made economically excellent.

However, the above operations by which main and sub rolls are replaced by hand are troublesome because the above operations include stopping of the hull remover and the like. Accordingly, there has been proposed a technology by which the replacement operations of the main and sub rollers can be omitted. The hull remover described in, for example, Japanese Examined Utility Model Application Publication No. 62-29064, Japanese Patent Application Laid-Open Publication No. 03-137945, and Japanese Patent Application Laid-Open Publication No. 2001-38230 has a configuration in which variable speed motors are directly connected to a main roll, and a sub one, respectively, are independently driven to be rotated from each other, and are regularly changed and switched from a high-speed side to a low-speed side, and from a low-speed side to a high-speed side. Thereby, the main and the sub rolls are equally worn because the rolls are regularly rotated in low and high speed alternately.

On the other hand, in the hull remover described in Japanese Patent Application Laid-Open Publication No. 03-106452, or Japanese Patent Application Laid-Open Publication No. 2006-312151, switching of the rotation numbers of the main and sub rolls is realized by a change gear mechanism or/and a clutch mechanism.

According to the change gear mechanism, large and small change gears fixed to a driving axis are selectively engaged with passive gears fixed to the rotation axes of the main and sub rolls. For the selective engagement, the driving axis, to which the change gears are fixed, is required to be moved in the axial direction.

The clutch mechanism uses clutch members installed onto the rotation axes of main and sub rolls. The clutch members can move in the axis directions of the rotation axes, and are restrained in the directions of the rotations, respectively. Then, there are large and small pulleys driven by a belt on the both sides of the above clutch members, and the clutch members can be selectively connected to the above pulleys. The clutch members move for rotation axes of the main and sub rolls at the same time, and, when the main roll is connected to the large pulley, the sub roll is connected to the small pulley, or vice versa. This mechanism is also required to have a configuration in which the clutch member moves along the rotation axis.

As the above devices are configured in such a way that a worn rubber roll for high speed is rotated at low speed, and a not-worn rubber roll for low speed is rotated at high speed by operating the change gear mechanism, or the clutch mechanism from the outside even in the hull removing operation by a one-touch method, the labor by which the rolls are conventionally exchanged can be omitted.

However, the hull remover described in the above-described Japanese Examined Utility Model Application Publication No. 62-29064, Japanese Patent Application Laid-Open Publication No. 03-137945, and Japanese Patent Application Laid-Open Publication No. 2001-38230 has a tendency that the remover is in overload operation because the driving motors are directly connected to the rotation axis of the low-speed side rubber roll, and that of the high-speed side one, respectively. In a word, the gap between the main and sub rubber rolls are configured to secure an appropriate contact pressure generated between the roll surface and the un-hulled rice in such a way that a predetermined husking rate (a number of un-milled rice to all numbers of added unhulled rice) is obtained. As the both rubber rolls are a viscoelastic material at this time, there is generated a maximum pressure in somewhat front side from the narrowest portion of the roll gap when the unhulled rice passes through the roll gap. The hull remover described in the Japanese Examined Utility Model Application Publication No. 62-29064, Japanese Patent Application Laid-Open Publication No. 03-137945, and Japanese Patent Application Laid-Open Publication No. 2001-38230 is required to have a large rotating driving force in order to overcome the above pressure. Accordingly, there have been a problem that the driving motors are always driven in an overload state. On the other hand, a hull remover described in Japanese Patent Application Laid-Open Publication No. 03-106452, and Japanese Patent Application Laid-Open Publication No. 2006-312151 has a merit that the repulsion forces from one couple of rolls are controlled when unhulled rice passes through the roll gap, and an excessive rotation driving force is not required to be applied to each of the driving motors because one no-end belt is wound on the pulley of the rotation axis of the high-speed side rubber roll and that of the rotation axis of the low-speed side rubber roll like cross-coupled.

However, even the hull remover described in Japanese Patent Application Laid-Open Publication No. 03-106452, or Japanese Patent Application Laid-Open Publication No. 2006-312151 has the following problems. For example, when the supplied amount of un-hulled rice is increased, a load applied to a rubber roll is increased, that is, the load on the rotation axis of a rubber roll is increased, and the axis shape of the rotation axis is changed by heat expansion and the like. Then, there has been a possibility that the switching operation becomes difficult when the gap between the main roll and the sub roll is adjusted to be made larger, or narrower, because the movements of the change gears, and that of the clutch member are in bad condition for movement in the rotation-axis direction.

SUMMARY OF THE INVENTION

The present invention relates to a husking-roll driving device in a hull remover. The present invention has a technical object that there is not required a large rotation driving force almost the same as that of a hull remover, in which a driving motor is directly connected to the rotation axis, and, even when thermal expansion causes deformations of the rotation axes of the main and sub rolls, switching of the high-speed rotation sides of the main and sub rolls to the low-speed rotation sides, and that of the low-speed rotation side to the high-speed rotation side can be alternately and easily performed.

The hull remover according to the present invention is provided with a main and a sub rolls which are rotated in the internal direction, and at different numbers of rotations from each other, a first drive system, in which one of the main and sub rolls are rotated at higher speed, the other of the rolls are rotated at lower speed, a second drive system in which one of the main and sub rolls is rotated at a lower speed, and the other one is driven at a higher speed, a first and a second belt clutch mechanisms in which power is transmitted to the main and sub rolls by switching the above drive systems, and actuators driving the belt clutch mechanisms.

The main and sub rolls are a couple of husking rolls. Moreover, the words, "main and sub", are used only for distinction of each of the couple of rolls, and there is no distinction in the husking performances of rolls.

A first large-diameter pulley is axially supported on one of the rotation axes of the main and sub rolls, and a first small-diameter pulley is axially supported on the other rotation axis, respectively.

The first drive system includes: a first large-diameter pulley; a first small-diameter pulley; a drive pulley of the first motor; and a first no-end belt which is stretched among the above pulleys, and connect the above components.

The second drive system includes: a second small-diameter pulley which is axially supported onto the above-described one rotation axis; a second large-diameter pulley which is axially supported onto the above-described other rotation axis; a drive pulley of a second motor; and a second no-end belt which is stretched among the above pulleys and connects the above-described components.

A first belt clutch mechanism is provided with a first arm member and an actuator.

The first arm member is provided with a tension clutch pulley at the point portion of an arm projecting in the radial direction. The first arm member is rotated around the other rotation axis by the actuator. When the first arm is rotated, power is given or cutoff to the first large-diameter pulley in the first drive system.

The second belt clutch mechanism is provided with the second arm member and an actuator in the same manner as that of the first belt clutch mechanism. The second arm member is provided with tension clutch pulley in the point portion of an arm projecting in the radial direction. The second arm member is rotated by the actuator around the other rotation axis. When the arm is rotated, power is given or cutoff to the second large-diameter pulley in the second drive system.

The first arm member and the second arm member are rotated by the actuator at the same time.

The first belt clutch mechanism performs switching between a position, at which the first no-end belt in the first drive system is wound around the first large-diameter pulley, and a position at which the winding is avoided. At the same time, the second belt clutch mechanism performs switching between a position at which winding of the second no-end belt in the second drive system around the second large-diameter pulley is avoided and a position at which the second no-end belt is wound around the second large-diameter pulley.

That is, when the first no-end belt is wound around the first large-diameter pulley, and power is transmitted to the first large-diameter pulley, winding of the second no-end belt around the second large-diameter pulley are avoided, and power cannot be transmitted to the second large-diameter pulley. On the other hand, when the first no-end belt transmits power to the first large-diameter pulley axially supported onto one of the rotation axes, power is also transmitted to the first small-diameter pulley which is axially supported on the other axis. Oppositely, when the second no-end belt transmits power to the second large-diameter pulley axially supported onto the other rotation axis, power is also transmitted to the second small-diameter pulley axially supported on the one rotation axis. Thereby, the main and sub rolls are simultaneously rotated at the same time with a difference in speed, and switching between the high-speed rotation side and the low-speed rotation side is performed.

The first arm member includes a supporting end portion which is rotatably installed onto one rotation axis; and an arm portion with a shape of approximately V character extending in the radial direction of the first large-diameter pulley from the supporting end portion. In the arm portion with a shape of approximately V character, it is desirable to assume that the interior angle ($\alpha$) is 60°.

Similarly, the second arm member includes a supporting end portion which is rotatably installed onto the other rotating axis; and an arm portion with a shape of approximately V character extending from the supporting end portion in the radial direction of the second large-diameter pulley. In the arm portion with a shape of approximately V character, it is desirable to assume that the interior angle ($\alpha$) is 60°.

The actuator can be assumed as a rotary actuator rotating the first arm member and the second arm member, respectively.

The actuator further includes a chain sprocket transmission mechanism.

A chain sprocket transmission mechanism is provided with a first sprocket fixed onto the first arm member; a second sprocket fixed onto the second arm member; a double sprocket connecting the first and the second sprockets; and a rod-type actuator. Then, a chain wraps between the first sprocket and the double sprocket, and between the second sprocket and the double sprocket, respectively. The double sprocket is arranged in such a way that the sprocket is rotated about 90 degrees by a rod-type actuator.

When the double sprocket is rotated, the first and second arm members are synchronously rotated. Then, when the no-end belt in the above-described first drive system is at a position at which the no-end belt is wound around the above-described first large-diameter pulley, and power can be transmitted, the no-end belt in the above-described second drive system is assumed to be at a position at which winding around the above-described second large-diameter pulley is avoided. And, when the no-end belt in the above-described second drive system is at a position at which the no-end belt is wound around the above-described second large-diameter, and power can be transmitted, the no-end belt in the above-described first drive system is assumed to be at a position at which winding around the above-described first large-diameter pulley is avoided.

Sometimes, there is provided a case in which there is provided a first idler pulley, which gives contraction and expansion to the above-described no-end belt by contraction and expansion of an air cylinder, in the first drive system, and there are provided a second idler pulley and a third idler pulley, which gives contraction and expansion to the above-described no-end belt by expansion and contraction of an air cylinder, in the second drive system.

As described above, the present invention has a configuration in which, instead of a configuration in which a clutch is moved back and forth in the rotation axis direction of conventional main and sub rolls, the operation of the first drive system and that of the second drive system are switched by rotating the first arm member and the second one. Thereby, even when thermal expansion etc. causes deformation of the rotation axis, a changing operation may be easily executed in which switching a high-speed side to a low-speed side, and the low-speed side to the high-speed side, alternately. Moreover, as the present invention does not use parts such as a clutch member, which slides in the rotation axis direction, and, at each operation, impact and wear are easily generated, the invention is excellent in durability, though switching operation for the belt clutch mechanism and the idler pulley is repeatedly performed.

When the arm portions of the first and the second arm members has a shape of approximately V character with an interior angle ($\alpha$) of about 60°, spacing between a couple of tension clutch pulleys, which are installed in the point portions of the first and the second arm members, is made somewhat larger. Thereby, for example, in a state in which the power transmission to the first large-diameter pulley and the second large-diameter pulley is released, even in a case in which the outside diameters of these pulleys are large, for example, about 220 mm, a state in which the first and the second no-end belts unexpectedly wind around the above pulleys, and the power is transmitted is surely prevented, and "POWER-ON" and "POWER-OFF" operations are surely executed.

As the rotary actuator a high torque, and the arm portion can treat a large rotation angle when the first and the second arm members are rotated by a rotary actuator, the "POWER-ON" and "POWER-OFF" operations can be surely executed.

When a rod-type air cylinder and a chain sprocket transmission mechanism are used for rotation of the first and the second arm members, the operations of the belt clutch mechanisms in the first drive system and the second drive system can be easily synchronized, by one air cylinder, furthermore, in comparison with a case in which a plurality of rotary actuators are used, manufacturing costs can be suppressed with a simple configuration because an electromagnetic valve, a logic relay, and the like for synchronization between the first and the second drive systems are not required.

The first idler pulley in the first drive system, and the second idler pulley in the second drive system, perform contraction and expansion of the first and the second no-end belts by the expansion and contraction of the air cylinder, respectively. Accordingly, the contraction and the expansion of the first and the second no-end belts can be easily performed only by expansion and contraction of an air cylinder. Consequently, "POWER-ON" and "POWER-OFF" operations for power transmission to the first and the second large-diameter pulleys can be easily executed by the first and the second belt clutch mechanisms.

DETAILED DESCRIPTION OF THE PREFERRED EMBODIMENTS

Figure 1:
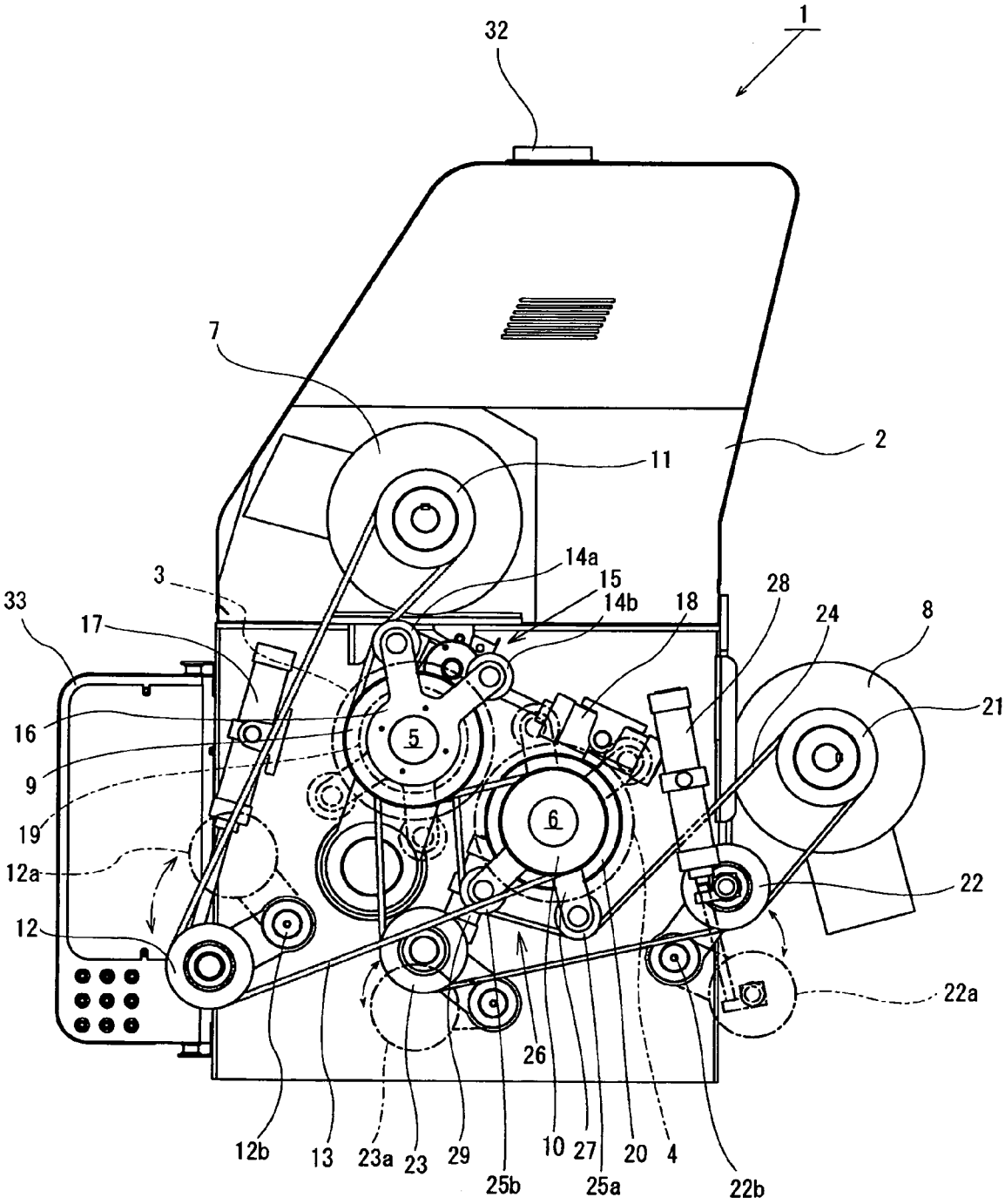
FIG. 1 is a side view showing a general view of a husking-roll driving device according to the present invention.
Figure 2:
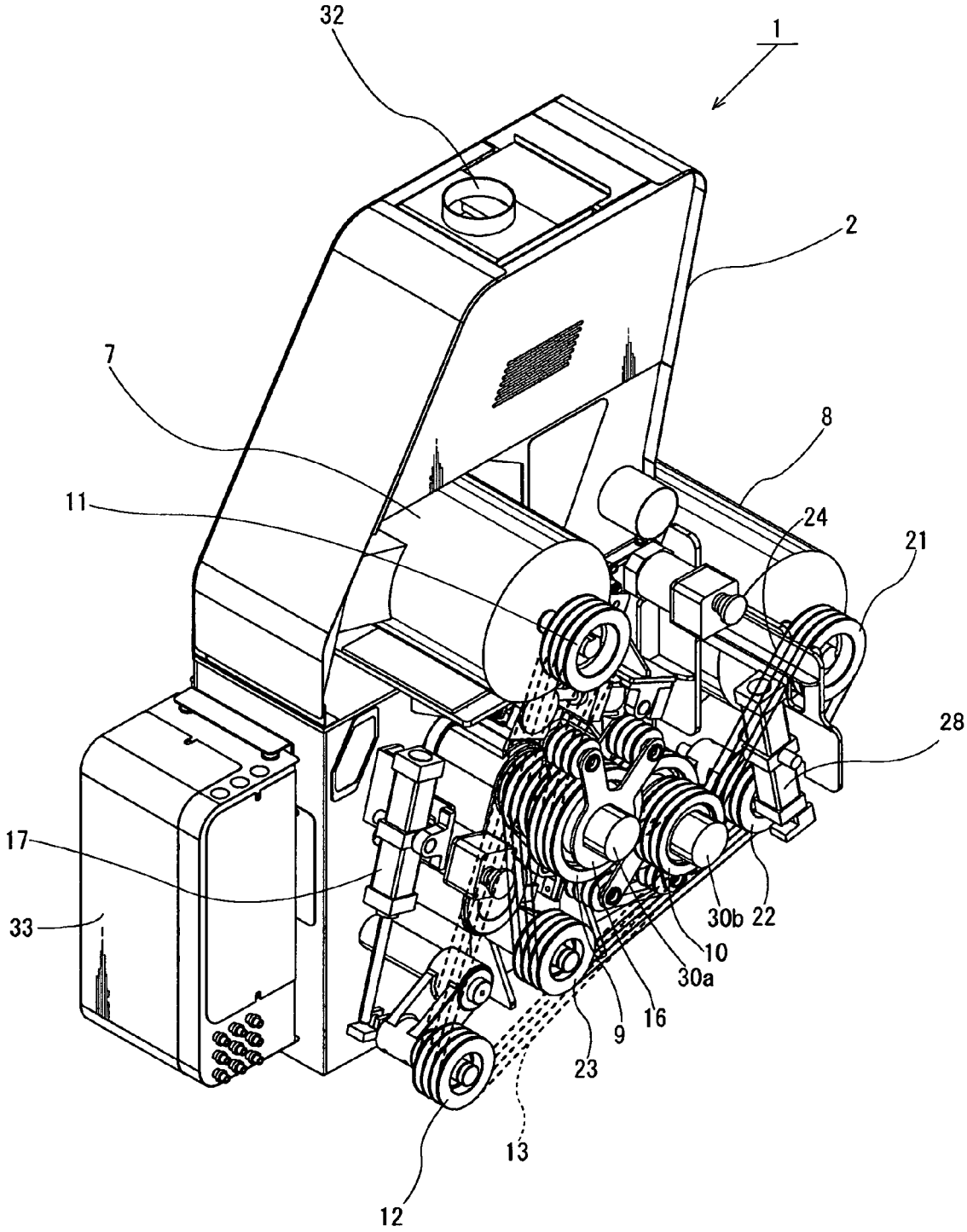
FIG. 2 is a perspective view of the husking-roll driving device according to the present invention, overlooking the device slantingly from the upward.

A best mode for carrying out the present invention will be explained, referring to drawings. FIG. 1 is a side view showing a general view of a husking-roll driving device according to the present invention; FIG. 2 is a perspective view of the husking-roll driving device according to the present invention, overlooking the device slantingly from the upward; In FIG. 1 and FIG. 2, a hull remover 1 is provided with a main roll 3 (husking roll) fixed to one rotation axis 5 in the lower portion of a device frame 2, and a sub roll 4 (husking roll) which is fixed to the other rotating axis 6, and is axially supported by the main roll 3 in such a way that near far adjustment can be executed. The main and sub rolls 3 and 4 are arranged in such a way that the rolls are rotated in the internal direction, and at different rotation numbers from each other.

There are provided a later-described first driving motor 7 in the center portion of the device frame 2, and, a second driving motor 8 on the side surface of the device frame 2, respectively. On the other hand, a first large-diameter pulley 9 is fixed near the outside in the axial direction of the above-described one rotation axis 5, and a first small-diameter pulley 10 is fixed near the outside in the axial direction of the other rotation axis 6, respectively. Then, the first no-end belt 13 is wound among the first large-diameter pulley 9, the first small diameter pulley 10, the drive pulley 11 of the driving motor 7, and the first idler pulley 12 provided in the lower portion of the above-described device frame 2 to connect them each other, and the first drive system is formed. The first no-end belt 13 in this first drive system is wound cross-coupled in such a way that the first large-diameter pulley 9 and the first small diameter pulley 10 are rotated in the inward direction, and is wound on the first large-diameter pulley 9 at the back of the belt, and, at the same time, on the first small diameter pulley 10 at the inner side of the belt. In FIG. 1, the first no-end belt 13 is arranged in such a way that the belt is rotated anti-clockwise.

Moreover, an arm member 16 provided with the arm portion having a shape of approximately V character is disposed on the first large-diameter pulley 9 in this first drive system.

The arm portion is extended from the center of the first large-diameter pulley 9 in the radial direction, and the point is rotated around the one rotating axis 5 in such a way that a rotation track is drawn on the outer periphery of the large-diameter pulley 9. When this arm member 16 is rotated as one operation, the power is or cutoff to the first large-diameter pulley 9 of the first no-end belt 13. That is, the first belt clutch mechanism 15 includes the arm member 16 and the first no-end belt 13. Signs 14*a* and 14*b* indicates a couple of tension clutch pulleys installed at the point of the above-described arm member 16. As shown in FIG. 1 and FIG. 2, a position of a solid line of the first belt clutch mechanism 15 is a position at which power is transmitted by winding the no-end belt 13 on the large-diameter pulley 9 for power transmission. Accordingly, the state is the "POWER-ON" one.

The first drive system is provided with the first idler pulley 12. The first idler pulley 12 can be rotated round a fulcrum 12*b* to a position (sign 12*a*) of a dotted and dashed line by expansion and contraction of the movable axis of an air cylinder 17.

Figure 3:
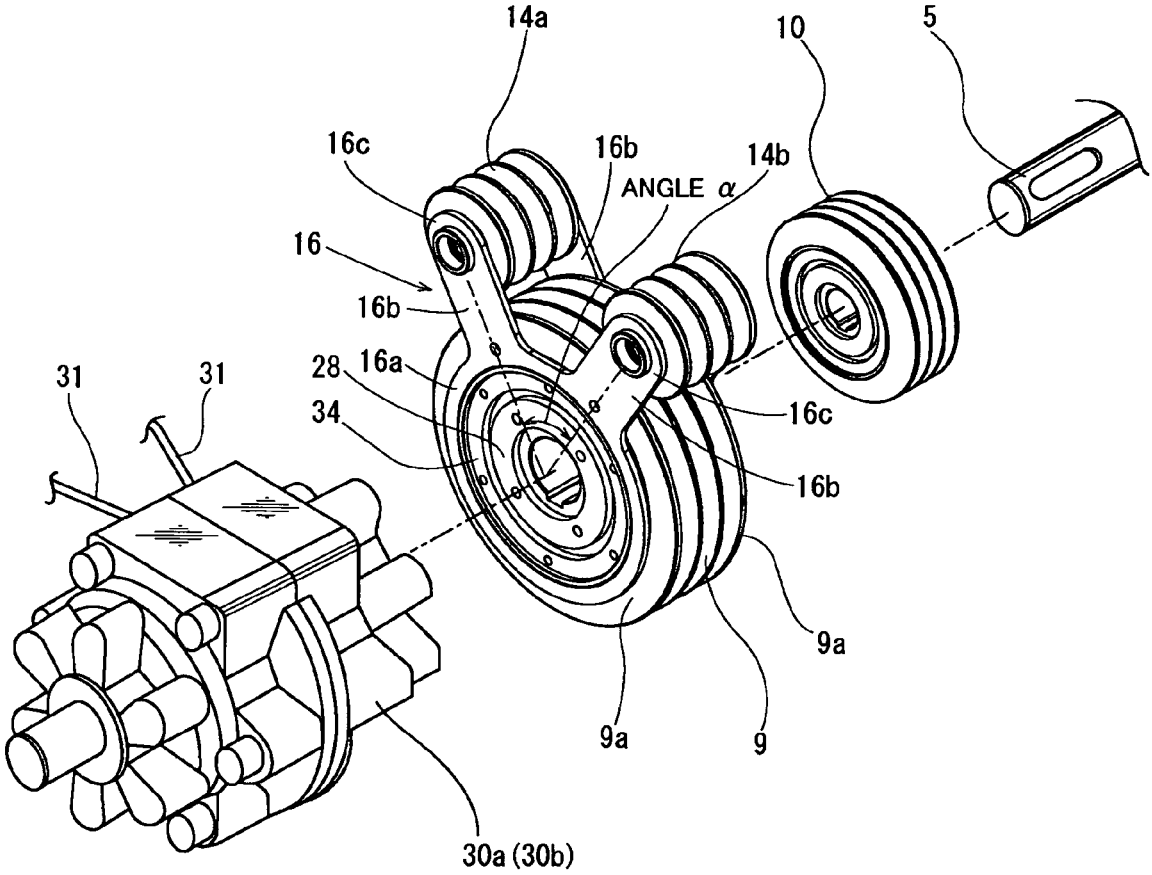
FIG. 3 is a perspective view showing a detailed structure of the belt clutch mechanism in the first drive system.

The first belt clutch mechanism 15 in the first drive system can be rotated to a position of a dotted and dashed line around the one rotation axis 5 by a rotary actuator 30*a* shown in FIG. 3. The position of a dotted and dashed line shows that the first no-end belt 13 is at a position at which winding onto the large-diameter pulley 9 is avoided, and in the "POWER-OFF" state.

In the above-described one rotation axis 5, and in the other rotation axis 6, the second small-diameter pulley 19 is fixed to the inner side in the axial direction adjacent to the first large-diameter pulley 9, and the second large-diameter pulley 20 is fixed to the inner side in the axial direction adjacent to above-described first small diameter pulley 10. Then, the second no-end belt 24 is wound among the second small diameter pulley 19, the second large-diameter pulley 20, the drive pulley 21 of the second driving motor 8, the second idler pulley 22 installed in the lower portion of the above-described device frame 2, and the third idler pulley 23 to connect them each other. The second drive system includes the second no-end belt 24 and these pulleys 20 to 23.

In such a way that the second small diameter pulley 19 and the second large-diameter pulley 20 are mutually and inwardly rotated, the second no-end belt 24 of the second drive system is wound on the second small diameter pulley 19 at the inner side of the belt and, at the same time, is wound cross-coupled on the second large-diameter pulley 20 at the back of the belt. In FIG. 1, the second no-end belt 24 is configured to be rotated clockwise.

Furthermore, the second arm member 27 with a shape of approximately V character is disposed on the second large-diameter pulley 20 in this second drive system in such a way that a rotation track is drawn around the other rotation axis 6 on the outer periphery of the large-diameter pulley 20 by the point of the arm portion. The second belt clutch mechanism 26 is formed with the second arm member 27 and the second no-end belt 24. That is, when the second arm member 27 is rotated by an instruction of an operator, "POWER-ON" or "POWER-OFF" for power transmission to the above-described second large-diameter pulley 20 is executed. Signs 25*a* and 25*b* represents a couple of tension clutch pulleys installed at the point of the arm portion in the second arm member 27. Here, the solid-line positions of the second belt clutch mechanism 26 shown in FIG. 1 and FIG. 2 show a state in which the power transmission to the second large-diameter pulley 20 is in a "POWER-OFF" state.

The second idler pulley 22 in the second drive system can be rotated around a fulcrum 22*b* to a position (sign 22*a*) of a dotted and dashed line by expansion and contraction of a movable axis of an air cylinder 28. Moreover, the third idler pulley 23 can be rotated around a fulcrum to a position (sign 23*a*) of a dotted and dashed line by expansion and contraction of a movable axis of an air cylinder 29. Then, the second belt clutch mechanism 26 in the second drive system is configured to be rotated to a position of a dotted and dashed line around the other rotation axis 6 by an air cylinder (not shown) or by a rotary actuator 30*b* shown in FIG. 3. The position of a dotted and dashed line shows a state in which the power transmission to the second large-diameter pulley 20 is in a "POWER-ON" state.

FIG. 3 shows a detailed structure of the first belt clutch mechanism 15 in the above-described first drive system. The first small-diameter pulley 10 and the first large-diameter pulley 9 are fixed to one rotating axis 5 of the main roll 3, and the first arm member 16 with a shape of approximately V character is provided in such a way that the member 16 is sandwiching the end surfaces 9*a* and 9*a* of the first large-diameter pulley 9. The outside diameter of the first large-diameter pulley 9 is about 220 mm, and the outside diameter of the small-diameter pulley 10 is about 160 mm. In the above-described first arm member 16, the supporting end portion 16*a* is rotatably pivoted to the one rotating axis 5 through a bearing 28. The pivot is put on to a free turn. There is formed an arm portion 16*b* with a shape of approximately V character which is extending in the direction of the outer periphery from the supporting end portion 16*a* along the radius of the first large-diameter pulley 9. The interior angle ($\alpha$) between the arm portions 16*b* and 16*b* is about 60°. Then, there are installed rotatable tension clutch pulleys 14*a* and 14*b* at the point portions 16*c* and 16*c* of the first arm member 16. Thereby, even if the first large-diameter pulley 9 is a large-diameter pulley with an outside diameter of about 220 mm, switching between a state in which the first no-end belt 13 is wound on the first large-diameter pulley 9 and a state in which the above winding is avoided can be surely realized by the first belt clutch mechanism 15. Accordingly, "POWER-ON" (transmission) and "POWER-OFF" (nontransmission) can be surely realized for power transmission to the first large-diameter pulley 9.

Moreover, a rotary actuator 30 is installed in the first arm member 16 through a mount 34. In the rotary actuator 30, the first arm member 16 is rotated in the circumference direction around one rotation axis 5 by sliding of an internal vane (blade) based on an air pressure supplied from a air piping 31. A commercial product such as Model RAK300 made by KOGANEI Co. Ltd can be used for the rotary actuator 30.

Even the second belt clutch mechanism 26 of the second drive system has the same configuration as that shown in FIG. 3, and the only one different point is in the installation direction of the second arm member 27.

Here, sign 32 shown in FIG. 1 and FIG. 2 denotes a supply port provided in the upper portion of the device frame 2 for supplying grain. In the device frame 2, there are installed a vibration feeder just under the supply port 32, and a chute for supplying grain between the main and the sub rolls 3 and 4. The vibration feeder can adjust the flow quantity of grains.

Sign 33 is a pneumatic controller provided in the side portion of a device frame 2. The pneumatic controller 33 supplies high-pressure air supplied from an air supply source such as a compressor (not shown) to respective air cylinders 17, 28, and 29, a rotary actuator 30, and so on. Thereby, the pneumatic controller 33 includes: an electromagnetic valve; a logic relay; a breaker; a terminal board and the like (Neither is not shown in figures). Moreover, sign 18 is a roll gap adjustment unit adjusting a roll gap in such a way to achieve a predetermined husking rate.

Hereafter, operation procedures for the husking-roll driving device according to the present invention will be explained, referring to FIG. 4.

It is assumed that the hull remover 1 is provided with main and sub rolls 3 and 4 (rubber rolls) as new articles. An operator adjusts the position of the first belt clutch mechanism 15, and operates the first idler pulley 12 to tense the first no-end belt 13. Then, there is obtained a state in which the husking operation can be started by the first drive system.

Figure 4A:
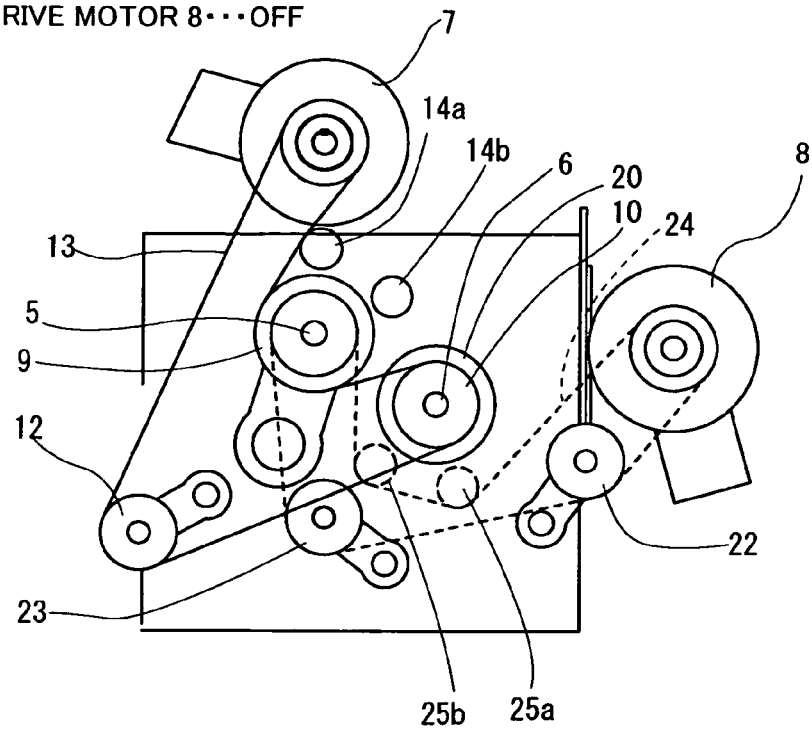
FIG. 4A is a schematic view showing the operation state of the active first drive system and passive second drive system.
Figure 4B:
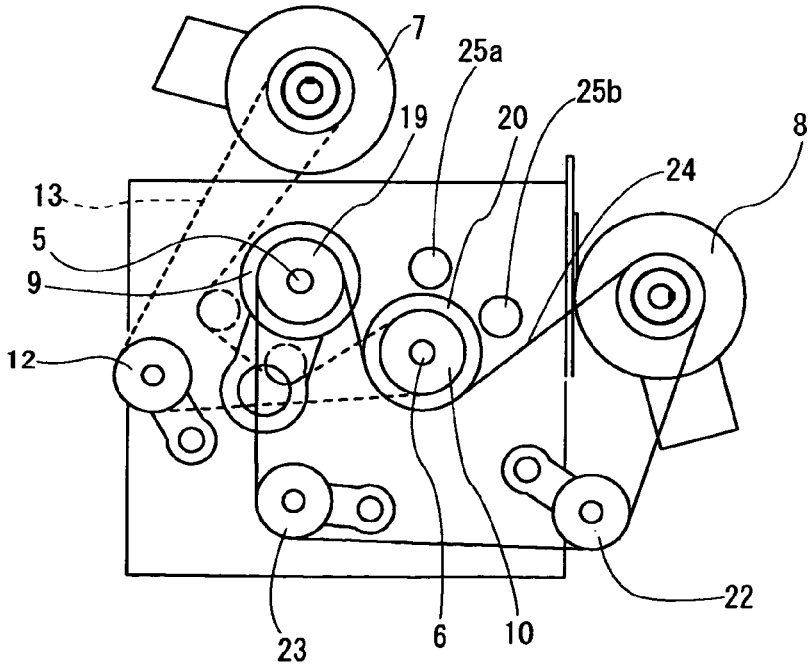
FIG. 4B is a schematic view showing the operation state of the active second drive system and passive first drive system.

That is, the first rotary actuator 30*a* is controlled to rotate the first arm member 16 in such a way that the tension clutch pulleys 14*a* and 14*b* are at positions represented by the solid line in FIG. 4A. Thereby, a state in which the power is transmitted to the first large-diameter pulley 9 in the first belt clutch mechanism 15 is in the "POWER-ON" state. Then, a movable axis of the air cylinder 17 is expanded, and the first idler pulley 12 is moved to a position represented by the solid line in FIG. 4A. Then, the no-end belt 13 is tensed, and there is caused a state in which power can be transmitted from the first no-end belt 13 to the first large-diameter pulley 9.

On the other hand, the second belt clutch mechanism 26 is not operated, and the power-transmission state of the second no-end belt 24 to the second large-diameter pulley 20 is kept in the "POWER-OFF" state.

Under such a condition, the power supply of the hull remover 1 is switched on to start the driving of the first driving motor 7. The second drive motor 8 is stopped.

The driving force of the first drive motor 7 is transmitted to the first large-diameter pulley 9 and the first small diameter pulley 10 through the first no-end belt 13 in the first drive system. The main roll 3 is rotated at a low number of rotations, and, at the same time, the sub roll 4 is rotated at a high number of rotations. The both rolls are inwardly rotated each other.

Then, grains supplied from the supply port 32 are subjected to husking operations by the difference in the peripheral velocity between the main and sub rolls 3 and 4, and the pressing force.

Thus, husking operations are continued under a state in which the first drive system is in a driving state, and the main roll 3 and the sub roll 4 are worn. As the sub-roll 4 rotating at a higher number of rotations, in comparison with the case of the main roll 3 rotating at a low number of rotations, has more broader area for contacting with un-hulled rice, the sub-roll 4 is worn out earlier than the main roll 3. As a result, the outside diameter of the sub roll 4 becomes smaller and there is reduced difference in the peripheral velocity between the main roll 3 and the sub roll 4. Here, for example, when the difference in the peripheral velocity falls below a fixed value by one percent, there is caused an operation in which an operation by which a driving unit is switched from the first drive system to the second drive system.

In switching from the first drive system to the second drive system, first of all, driving of the first driving motor 7 is stopped, and, then, the air cylinder 17 is operated to rotate the first idler pulley 12 upward, and to relax the first no-end belt 13. Then, the rotary actuator 30*a* is controlled to rotate the first arm member 16, and the positions of the tension clutch pulleys 14*a* and 14*b* of the belt clutch mechanism 15 are configured to be at positions represented by the dashed line in FIG. 4B. At this time, the rotation of arm member 16 is rotated anti-clockwise about 175°. That is, the first belt clutch mechanism 15 sets the state of power transmission to the first large-diameter pulley 9 in the first no-end belt 13 as a state of "POWER-OFF".

Moreover, the second drive system is started by the second belt clutch mechanism 26, the second idler pulley 22, and the third idler pulley 23. That is, the second rotary actuator 30*b* is controlled to rotate the second arm member 27. By this rotation, the tension clutch pulleys 25*a* and 25*b* at the point portion of the arm portion 16*b* to be at positions represented by the solid line in FIG. 4B. In this case, the second arm member 27 is rotated anti-clockwise by about 175° in the drawing. As a result, the second belt clutch mechanism 26 sets the state of power transmission from the second no-end belt 24 to the second large-diameter pulley 20 as a state of "POWER-ON". Then, the movable axes of the air cylinders 28 and 29 are expanded, and the second idler pulley 22 and the third idler pulley 23 are moved to a position represented by the solid line in FIG. 4B to tense the no-end belt 24.

When the second driving motor 8 is driven under such a condition (the first drive motor is stopped), the driving force of the driving motor 8 is transmitted to the second large-diameter pulley 20 and the second small diameter pulley 19 through the second no-end belt 24 in the second drive system. Different from the above-described conditions, the main roll 3 is rotated at a high number of rotations. At the same time, the sub-roll 4 is rotated at a low number of rotations, and the both rollers are inwardly rotated, facing each other.

As described above, the operations of the first and second motors 7 and 8, the first and the second belt clutch mechanisms 15 and 26, and the first to the third idler pulleys 12, 22, and 23 are switched to the husking operation for continuation.

In this example, there has not been used a conventional clutch with a structure in which slides in a direction of rotation axis of the husking roll. Accordingly, even when there is caused a deformation of a rotation axis, which is caused by thermal expansion, alternate switching operations, in which a roll on a high-rotation side is easily changed to a roll on a low-rotation side or reversed switching, can be surely performed. Moreover, the present example is excellent in durability, because the present example has not used parts such as a clutch member sliding in the direction of rotation axis, and easily cause impacts and wears at each operation. Moreover, a large rotation driving force is not required because the configuration is different from a conventional one in which a driving motor is directly connected to the rotation axis of the husking-roll.

Then, another example for an actuator rotating the first and the second arm members 16, and 27 will be explained. The explanations will be made, referring to FIG. 5 and FIG. 6.

Figure 5:
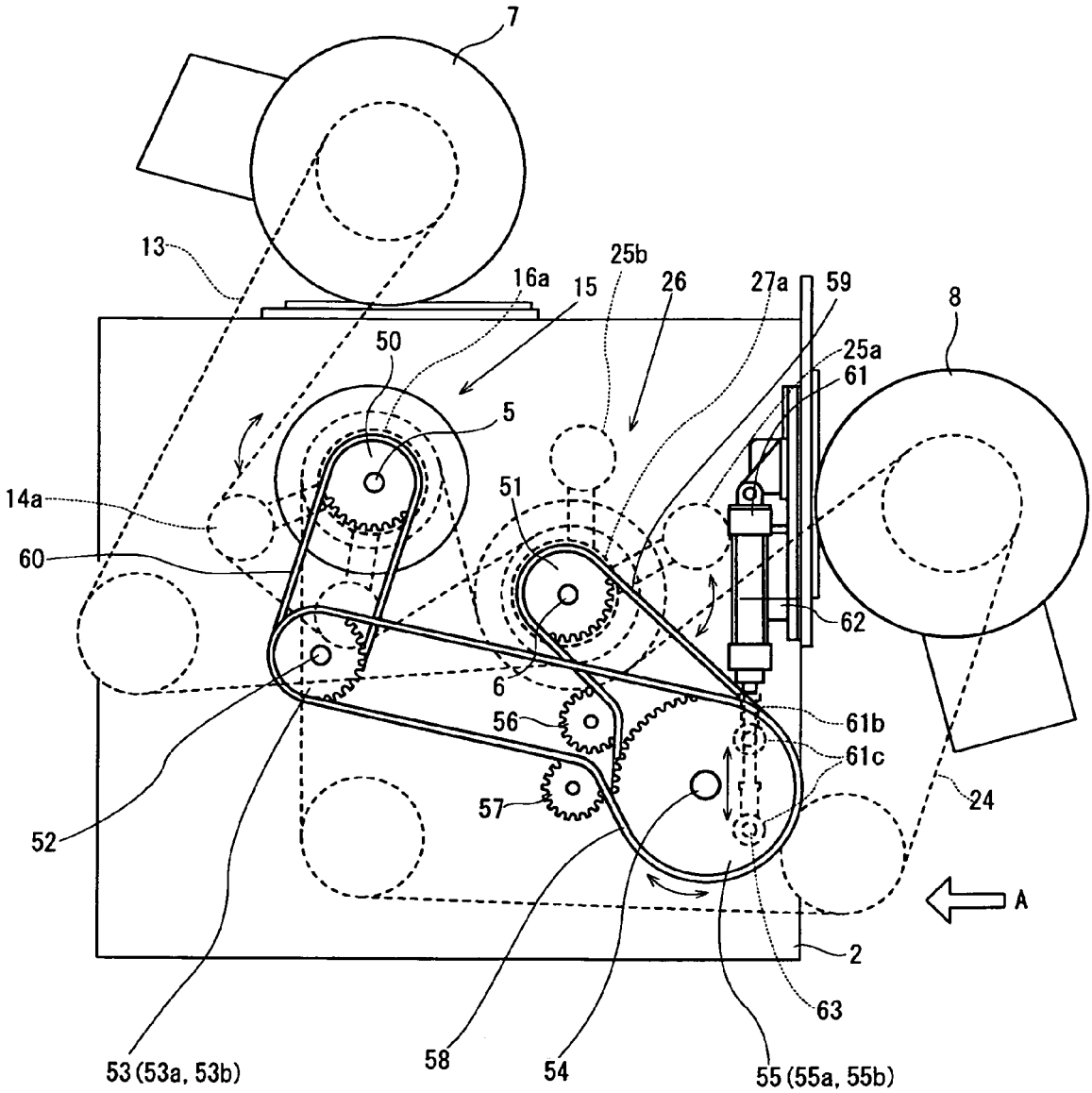
FIG. 5 is a schematic side view showing a chain sprocket transmission mechanism for rotating an arm member.
Figure 6:
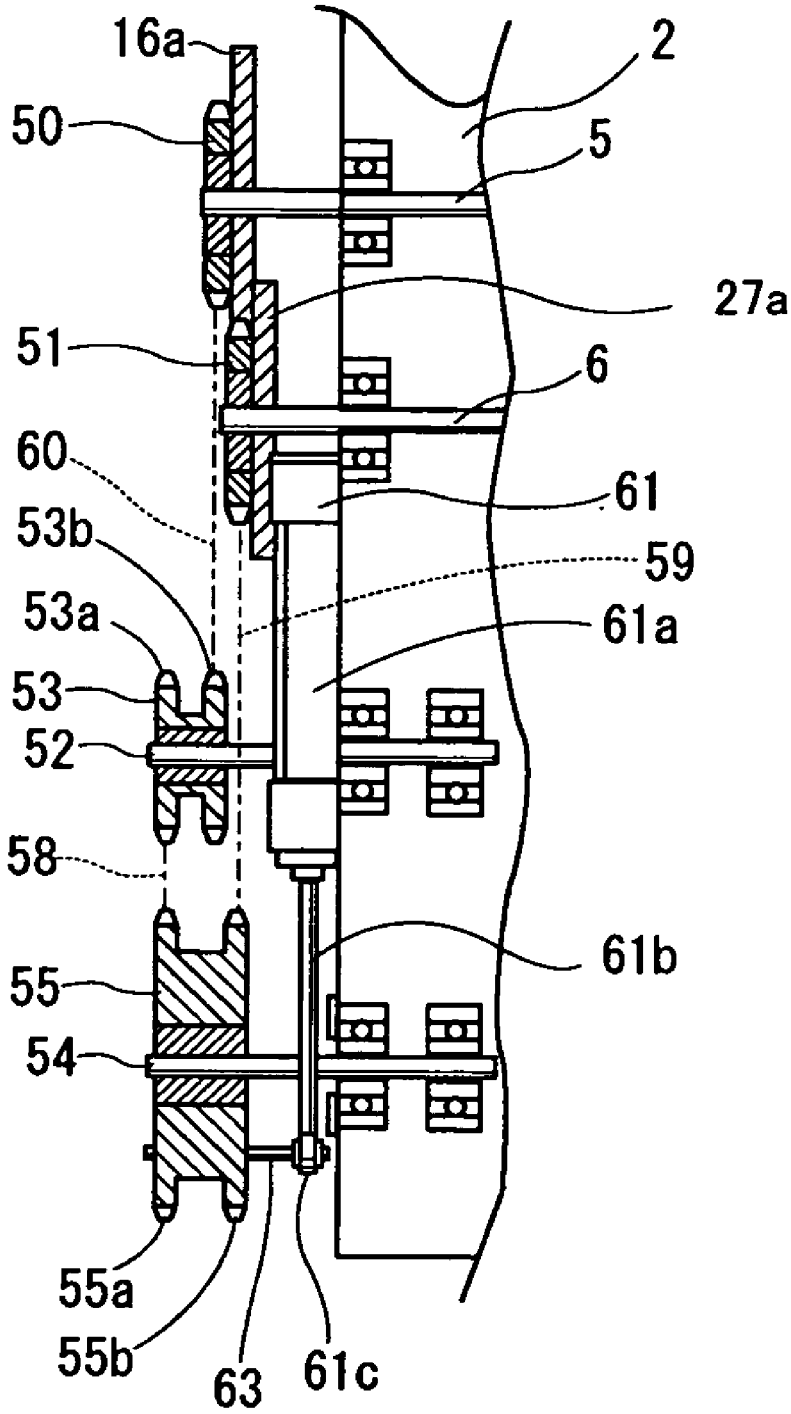
FIG. 6 is a schematic explanatory view showing a relation between a chain and a sprocket, seeing the direction of the arrow A in FIG. 5.

FIG. 5 is a schematic side view showing a chain sprocket transmission mechanism as an actuator rotating the first and the second arm members 16 and 27. FIG. 6 is a schematic explanatory drawing showing a connection between a chain and sprockets, taken in the direction of the arrow along the line A in FIG. 5.

Referring to FIG. 5 and FIG. 6, the first sprocket 50 is fixed to the supporting end portion 16*a*, using bolts, nuts, and the like (not shown) in the first arm member 16 in the first belt clutch mechanism 15 of the first drive system. A second sprocket 51 is fixed to the supporting end portion 27*a* in the second arm member 27 of the belt clutch mechanism 26 in the second drive system, using bolts, nuts, and the like (not shown). And, a double sprocket 53 for relay is rotatably installed onto a rotation axis 52 pivoted to the device frame 2 under the first sprocket 50. Moreover, a double sprocket 55 for synchronization is rotatably installed onto a rotation axis 54 pivoted to the device frame 2 under the second sprocket 51. Moreover, a plurality of sprockets for tension 56 and 57 are provided at proper locations corresponding to the above-described double sprockets 53 and 55 in the device frame 2.

The diameters of the first sprocket 50, the second sprocket 51, and the double sprocket 53 for relay have a diameter of 116 mm, a number of teeth of 27, while the double sprocket 55 has a diameter of 226 mm and the numbers of teeth of 54. Moreover, the speed ratio is 1:2. That is, the double sprocket 55 is provided for synchronization in the rotation between the first sprocket 50 and the second sprocket 51. When the double sprocket 55 for synchronization is rotated about 90° as a rotation angle, the first sprocket 50, the second sprocket 51, and the double sprocket 53 for relay are set to be rotated about 180° as a rotation angle.

A first chain 58 is wound on the sprocket 55*a* on the one side of the double sprocket 55 for synchronization, the sprocket 53*a* on the one side of the double sprocket 53 for relay, and the sprocket 57 for tension. Similarly, a second chain 59 is wound on the other-side sprocket 55*b* of the sprocket 55 for synchronization, the second sprocket 51, and the sprocket 56 for tension. A transmission chain 60 for power transmission at a speed rate of 1:1 is wound on between the other-side sprocket 53*b* of the sprocket 53*b* for relay and the first sprocket 51.

The double sprocket 55 for synchronization is rotated by a rod-type air cylinder 61. In this rod-type air cylinder 61, a movable rod expands and contracts on a straight line, and the cylinder can be used as an actuator.

In the rod-type air cylinder 61, a cylinder portion 61*a* is fixed to the device frame 2 through a seating 62. A point portion 61*c* in the movable rod portion 61*c* pivoted to the double sprocket 55 for synchronization through a pivoting pin 63. Accordingly, when a movable rod portion 61*b* is moved forward and backward, the double sprocket 55 for synchronization is configured to be rotated. For example, when the stroke of the movable rod portion 61*b* is about 100 mm, the double sprocket 55 for synchronization can be rotated by about 90°.

Operations of the above-described chain sprocket transmission mechanism will be explained, referring to FIG. 4, FIG. 5, and FIG. 6.

It is assumed a state in which new main and sub rolls 3 and 4 are installed in the hull remover. Husking operations are started by the first drive system. And, position adjustment of the first and the second belt clutch mechanisms 15 and 26 are performed at the same time.

That is, when the movable rod portion 61*b* in the rod-type air cylinder 61 is extended (Refer to FIG. 5), the double sprocket 55 for synchronization is rotated clockwise by about 90°. Accordingly, in the first drive system, through the first chain 58 and the transmission chain 60, the double sprocket 53 for relay, the first sprocket 50, and the supporting end portion 16*a* in the first arm member 16 are rotated about 180° clockwise. Then, the tension clutch pulleys 14*a* and 14*b* are moved to a position at which the first no-end belt 13 is wound onto the first large-diameter pulley 9. This state indicates that the state of power transmission to the first large-diameter pulley 9 is "POWER-ON".

On the other hand, in the second drive system, the supporting end portion 27*a* in the second arm member 27 is rotated about 180° in the clockwise direction through the second chain 59. Then, the tension clutch pulleys 25*a* and 25*b* at the point of the arm portion 16*b* are moved to a position at which the second no-end belt 24 is avoided to be wound onto the second large-diameter pulley 20. In this state, the state of power transmission to the second large-diameter pulley 20 is "POWER-OFF" (the state is shown in FIG. 4A, and FIG. 1.)

When, under such a condition, power is supplied to the hull remover 1, and driving of the first driving motor 7 is started (the second driving motor 8 is stopped), the driving power of the driving motor 7 is transmitted to the first large-diameter pulley 9 and the first small diameter pulley 10 through the first no-end belt 13 in the first drive system.

The main roll 3 is rotated at a low number of rotations, and, at the same time, the sub roll 4 is rotated at a high number of rotations. The both rolls are inwardly rotated, facing each other.

Then, grains supplied from the supply port 32 are subjected to husking operations by the difference in the peripheral velocity between the main and sub rolls 3 and 4, and the pressing force.

Thus, when the husking operations are continued in a state in which the first drive system is put into a driving state, there is executed an operation in which the state of the driving unit is switched from the first drive system to the second drive system because the main and the sub rolls 3 and 4 are worn out as described above.

When the sub roll 4 is worn out, and the first drive system is switched to the second drive system, first of all, driving of the first driving motor 7 is stopped, and, subsequently, the movable rod portion 61*b* in the rod-type air cylinder 61 is shrunk (Refer to FIG. 5). Then, the double sprocket 55 for synchronization is rotated about 90° counterclockwise. Accordingly, the double sprocket 53 for relay the first sprocket 50, and the supporting end portion 16*a* in the first arm member 16 are rotated about 180° counterclockwise through the first chain 58 and the transmission chain 60 in the first drive system, the state of power transmission from the first no-end belt 13 to the first large-diameter pulley 9 is a "POWER-OFF" state. At the same time, in the second drive system, the supporting end portion 27*a* of the second arm member 27 is rotated about 180° counterclockwise through the second chain 59 counterclockwise, and the state of power transmission from the second no-end belt 24 to the second large-diameter pulley 20 is a "POWER-ON" state. (state shown in FIG. 5 and FIG. 4B).

When driving of the second driving motor 8 is started under such a condition (the first drive motor 7 is stopped), the driving power of the second drive motor 8 is transmitted to the second large-diameter pulley 20 and the second small diameter pulley 19 through the second no-end belt 24 in the second drive system. Different from the above-described conditions, the sub roll 4 is rotated at a low number of rotations. At the same time, the main-roll 3 is rotated at a high number of rotations, and the both rolls are inwardly rotated, facing each other.

As described above, the husking operation is continuously executed by repeating the switching operation among the motor, the belt clutch mechanism, and the idler pulley. When such a rod-type air cylinder and a chain sprocket transmission mechanism is adopted, the belt clutch mechanism in the first drive system and the second drive system can be easily synchronized by one air cylinder. Moreover, in comparison with a case in which a plurality of rotary actuator are used, manufacturing costs can be suppressed with a simple configuration because an electromagnetic valve, a logic relay, and the like for synchronization are not required.

What is claimed is:

1. A husking-roll driving device in a hull remover, provided with a pair of husking-rolls which are driven and rotated by first and second motors, a first drive system, a second drive system, a first belt clutch mechanism, and a second belt clutch mechanism, wherein the pair of husking-rolls rotated in the internal direction, and at different rotation numbers from each other, the first drive system includes: a first large-diameter pulley fixed to one rotation axis of a pair of husking-rolls; a first small-diameter pulley fixed to the other rotation axis; and a first no-end belt which is wound among the first large-diameter pulley, the first small-diameter pulley, and the drive pulley of the first motor, to connects the pulleys, the second drive system includes components of: a second small-diameter pulley which is fixed to the one rotation axis fixing the first large-diameter pulley, a second large-diameter pulley fixed to the other rotation axis fixing the first small-diameter pulley, and a second no-end belt which is wound among the second small-diameter pulley, the second large-diameter pulley, and the drive pulley of the second motor and connects the components, a first belt clutch mechanism inputting power transmission to the first large-diameter pulley, is further provided in the first drive system, a second belt clutch mechanism inputting power transmission to the second large-diameter pulley, is further provided in the second drive system, the first belt clutch mechanism includes a first arm member which is extended in the radius direction around one rotation axis, and which is rotated in such a way that a first rotation track is drawn over the outer periphery of the first large-diameter pulley, a first tension clutch pulley installed at a point portion of the first arm member, and a first actuator rotating a first arm member, the first actuator can switch a position at which the first no-end belt in the first drive system is wound on the first large-diameter pulley for power transmission and a position at which winding is avoided, the second belt clutch mechanism includes a second arm member which is extended in the radius direction around the other rotation axis, and is rotated in such a way that a second rotation track is drawn over the outer periphery of the second large-diameter pulley, a second tension clutch pulley installed at the point portion of the second arm member, and a second actuator rotating a second arm member, and the second actuator can switch between a position at which a second no-end belt in the second drive system is wound on the second large-diameter pulley for power transmission and a position at which winding is avoided.

2. The husking-roll driving device in a hull remover according to claim 1, wherein the first and the second arm members includes: first and second supporting end portions which are rotatably pivoted to the one and the other rotation axes, respectively; and the arm portions which extend in the direction of the outer periphery from each of the first and second supporting end portions, and the interior angle ($\alpha$) between the two arm portions with a shape of an approximately V character have is about 60°.

3. The husking-roll driving device in a hull remover according to claim 1 or 2, wherein the first actuator is a first rotary actuator installed in a first arm member and the second actuator is a second rotary actuator in a second arm member, when a first no-end belt in a first drive system is rotated by a first large-diameter pulley and is at a position at which power is transmitted, a second no-end belt in a second drive system is at a position at which the second no-end belt in the second drive system avoids winding by the second large-diameter pulley, oppositely, when the second no-end belt in the second drive system is rotated by the second large-diameter pulley and is at a position at which power is transmitted, the first and the second arm members are synchronously rotated in such a way that the first no-end belt of the first drive system is at a position at which the first no-end belt in the first drive system is at a position at which winding of the first large-diameter pulley is avoided.

4. The husking-roll driving device in a hull remover according to claim 1 or 2, wherein:

the first and second actuators are a chain sprocket transmission mechanism including: first and second sprockets fixed to first and second arm members, respectively; a double sprocket connecting the first and second sprockets; and a series of chains which are wound on the first, second and double sprockets, a rod type air cylinder connected to the double sprocket, when a first no-end belt in a first drive system is wound on a first large-diameter pulley by operating the rod type air cylinder, and is at a position at which power is transmitted, a second no-end belt in a second drive system is at a position at which winding of a second large-diameter pulley is avoided, and, oppositely, when a second no-end belt in a second drive system is wound by a second large-diameter pulley and is at a position at which power is transmitted, the first no-end belt in the first drive system is at a position at which winding of a first large-diameter pulley is avoided, and a first and a second arm members are synchronously rotated respectively.

5. The husking-roll driving device in a hull remover according to claim 1 or 2, wherein there is provided a first idler pulley by which contraction and expansion of a first no-end belt is realized by expansion and contraction of an air cylinder, in a first drive system and, at the same time, in a second drive system, there is provided a second idler pulley and a third idler pulley, which executes contraction and expansion of a second no-end belt by expansion and contraction of an air cylinder.

* * * * *